United States Patent [19]

Sorensen

[11] 4,449,314

[45] May 22, 1984

[54] FIREARM SUPPORT

[76] Inventor: Richard L. Sorensen, Rte. 1, Box 182, Bandera, Tex. 78003

[21] Appl. No.: 415,665

[22] Filed: Sep. 7, 1982

[51] Int. Cl.[3] ..... F41C 29/00

[52] U.S. Cl. ..... 42/94; 211/64

[58] Field of Search ..... 42/94; 89/37 BA; 248/176–178, 187; 211/64; 73/167

[56] References Cited

U.S. PATENT DOCUMENTS

| | | | |
|---|---|---|---|
| 2,877,689 | 3/1959 | Pribis | 89/37 BA |
| 3,041,938 | 7/1962 | Seabrook | 42/94 |
| 3,361,265 | 1/1968 | Wernimont | 211/64 |
| 3,913,746 | 10/1975 | Burton | 211/64 |
| 3,964,613 | 6/1976 | Anderson, Jr. | 211/64 |
| 4,409,751 | 10/1983 | Goda et al. | 42/94 |

*Primary Examiner*—Charles T. Jordan

*Attorney, Agent, or Firm*—John C. Stahl

[57] ABSTRACT

A firearm support comprising an elongated base with front and rear support members each of which includes adjustable and coacting wedges adapted to receive and firmly grip selected portions of the stock of said firearm for displaying, cleaning and bore sighting purposes.

7 Claims, 7 Drawing Figures

FIREARM SUPPORT

BACKGROUND OF THE INVENTION

The prior art is replete with gun racks and rifle rests, typical examples of which are U.S. Pat. Nos. 2,290,545, 3,361,265, 3,767,093, 3,913,746 and 3,964,613. One salient feature in each of these teachings is that the firearm is only loosely secured in position.

SUMMARY OF THE INVENTION

The primary object of the invention is to provide a rifle support which firmly grips the firearms for display, cleaning and bore sighting purposes.

Another object is to provide such a rifle support which is adaptable for use with gunstocks of varying dimensions and cross-sectional configurations.

Still another object is to provide such a rifle support which is relatively inexpensive to manufacture, easy to use, and universal in its adaptability.

Other objects and features of the invention will become apparent to those skilled in the art from the following specification when read in the light of the annexed drawings.

DESCRIPTION OF PREFERRED EMBODIMENTS

Figure 1:
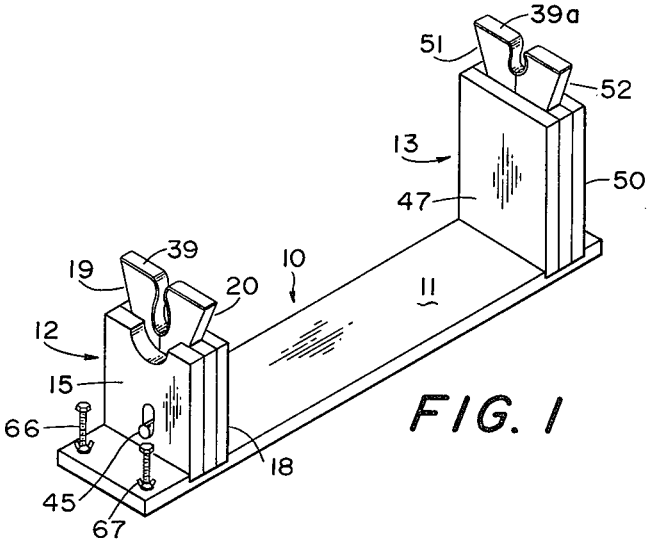
FIG. 1 is a perspective view of a preferred embodiment of firearm support of the subject invention.

Referring now to the drawings, wherein like reference characters designate like or corresponding parts throughout the several views, there is shown in FIG. 1 a preferred embodiment of firearm support 10 of the subject invention comprising base 11 with transversely and verticaly extending, longitudinally spaced first and second support members 12–13 conventionally secured in proximity to the opposing ends of said base. More specifically, base 11 of flat stock and of wooden or plastic composition includes transversely extending groove 14 of desired depth in the upper surface in proximity to the left-hand or rear end of said base. Rear support member 12 comprises outer plate 15, first and second polygonally-shaped and laterally spaced side members 16–17 which are mirror images of each other, inner plate 18, and vertically adjustable, coating wedges 19–20; each of said componetns are of wooden or plastic composition. Outer plate 15, generally of rectangular shape, includes base 21 equal in width to base 11, vertical sides 22–23, and top 24 with a medially and longitudinally extending arcuate recess 25 therein. Inner plate 18 is similar to outer plate 15 in shape and size. An elongated, vertically extending slot 26 is provided in the lower, medial portion of outer plate 15.

It is understood that plate 15, side members 16, 17 and inner plate 18 may be secured together by means of an adhesive, screws or other fastening means.. Furthermore, any desired number of such subcomponents may be molded together to form a single, integral structure or two or more readily assembled components.

Figure 2:
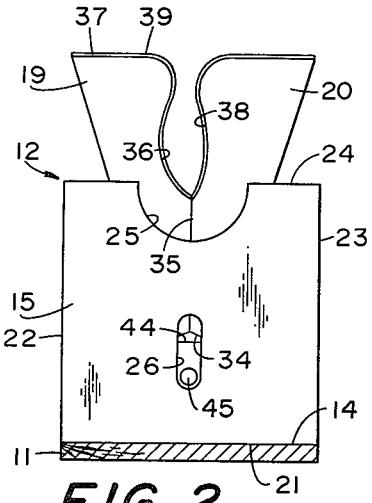
FIG. 2 is an enlarged elevational view of the rear support member, partly in section, looking inwardly.
Figure 3:
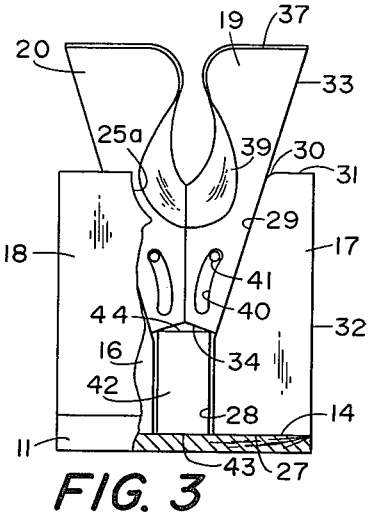
FIG. 3 is an enlarged elevational view of the rear support member, partly broken away and partly in section, looking outwardly.
Figure 4:
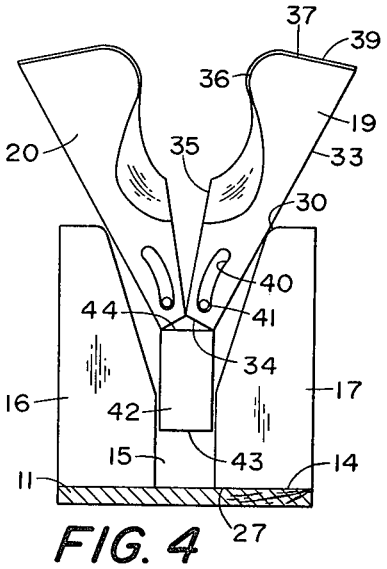
FIG. 4 is an enlarged, transversely extending, vertical sectional view taken through the rear support member, looking outwardly, showing the coacting wedges in elevated condition.

As best seen in FIGS. 2–4, coacting and vertically adjustable wedges 19, 20 are carried in rear support 12. For purposes of convenience only, side member 17 and wedge 19 will be described in detail; it is understood that side member 16 is a mirror image of member 17 and wedge 20 is substantially similar in construction to wedge 19, with the parts reversed. Member 17 includes base 27 approximately one-third the width of base 11 and carried in the outermost portion of groove 14, inner vertical side 28, and outwardly inclined surface 29 which terminates upwardly in radius 30; top 31 lies in the horizontal plane of top 24 of plate 15, and outer side 32 lies in the vertical plane of side 23 of said outer plate.

Wedge 19 includes outwardly inclined surface 33 paralleling surface 29 and adapted to bear uniformly thereagainst in normal condition; a relatively short base 34, extending angularly upwardly at approximately ninety degrees relative to surface 33, terminates in the medial plane; vertical side 35 terminates upwardly in the approximate horizontal plane of top 31 of member 17.

Wedges 19, 20 are desirably asymmetrical; wedge 19, for example, includes a relatively flat, S-shape curved inner surface 36 which fairs upwardly into horizontally extending top 37. The curvature of surface 36 is less pronounced than the corresponding curved inner surface 38 on opposing wedge 20; this difference in curvature between the coacting curved inner surfaces 36, 38 aids in gripping the stock or pistol grip of a firearm of any cross-sectional configuration. Desirably a shaped piece 39 of leather, felt or the like conforms to and is secured to top 37 and curved inner surface 36, said piece also extends laterally and downwardly on the inner face of said wedge, generally conforms to the curvature of recess 25*a* in inner plate 18, and protects the stock.

Referring now to FIGS. 3 and 4, arcuate slot 40 in the lower, medial portion of wedge 19 generally parallels inclined surface 33. Pin 41 passes through said slot and in normal condition bears against the upper end thereof, said pin is secured in plates 15, 18 in a conventional manner. It is to be understood that the invention is not to be restricted solely to such arcuate-shaped slot and the restraining means for the wedges. For example, a short projection may be formed on or secured to the inner surface of either plate 15 or plate 18 and at least partialy inserts into slot 40 of a shaped recess in the adjacent surface of the respective wedges.

Rectangular block 42 fits loosely between side 28 and the corresponding vertical side of member 16 and the respective inner surfaces of plates 15 and 18; in normal condition base 43 of the block abuts the flat of groove 14 while top 44 of said block bears against a selected portion of base 34 of wedge 19. Outwardly-extending pin 45, secured to said block in a conventional manner, extends through slot 26 heretofore mentioned.

When block 42 is raised by exerting an upward force on pin 45, wedge 19 slides upwardly on inclined surface 29; when reaching the position illustrated in FIG. 4, the wedge rides outwardly on radius 30 and pivots about pin 41 abutting the lower end of slot 40 whereby said wedge 19 and coacting wedge 20 are substantialy separated and a selected part of the stock or piston grip of the firearm may conveniently be inserted therebetween. The gun stock may be forced downwardly, securing the same between curved inner surfaces 36, 38 of the wedges.

Figure 5:
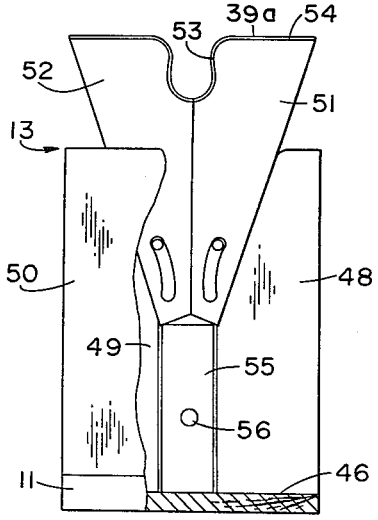
FIG. 5 is an elevational view of the front support member, partly broken away and partly in section, looking inwardly.
Figure 6:
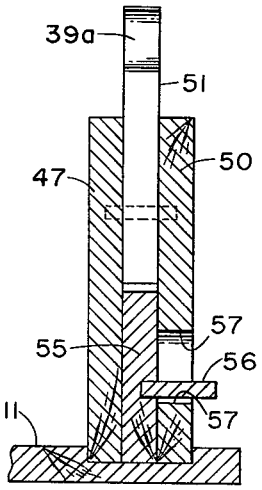
FIG. 6 is a vertical sectional view taken through the medial, longitudinal plane of the front support member.

There is shown in FIGS. 5–6 the second or front support member 13 conventionally secured in groove 46 is proximity to the right-hand end of said base. Front support 13 comprises inner plate 47, first and second flat, polygonally-shaped and laterally spaced side members 48–49 which are mirror images of each other, outer plate 50, and vertically adjustable, coacting wedges 51–52; each of said components are of wooden or plastic composition. Inner plate 47 and outer plate 50 are rectangular, of equal size, and terminate substantially above the horizontal plane of top 24 of plate 15 of member 12. Side members 48, 49 are mirror images of each other and except for the added height, such members are substantially similar to side members 16, 17 respectively.

Wedge 51 terminates upwardly in a curved inner surface 53 describing one-half of a vertical U which fairs into horizontally extending top 54. Piece 39*a* of leather or felt is secured to inner surface 53 and top 54 of said wedge to protect the abutting portions of the forearm of the stock from damage. Wedges 51, 52 thus formed are desirably symmetrical and substantially similar in shape and size to wedges 19, 20 on the rear support. Block 55 is supported on the flat of groove 46 and bears upwardly against selected portions of wedges 51, 52 in normal condition. Pin 56 conventionally secured to said block passes outwardly through elongated vertical slot 57 in the lower, medial portion of outer plate 50. Wedges 51, 52 may be raised in the manner heretofore described and when the forearm of the stock or barrel of the firearm is inserted therebetween and pressed downwardly, the coating curved inner surfaces firmly grip such parts.

Figure 7:
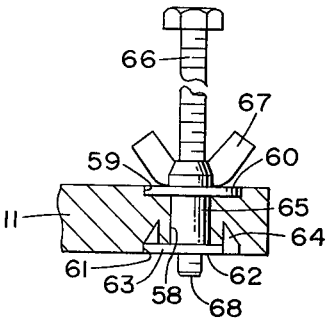
FIG. 7 is fragmentary, greatly enlarged vertical sectional view of base elevating means used for bore sighting purposes.

Referring now to FIGS. 1 and 7 of the drawings, there is shown elevating and leveling means in the rear end of the base principally used for bore sighting of a firearm. More particularly, vertically and laterally spaced bores 58 are provided in proximity to the corners of base 11 outwardly of rear support member 12. Bore 58 communicates upwardly with bore 59 of sufficient depth and diameter to receive washer 60 and downwardly with bore 61. Nut 62 such as is well known in the art includes disc 63 with upstanding prongs 64 circumferentially spaced thereabout and an integrally formed, centrally disposed collar 65 including female threads. Collar 65 is carried in bore 58 with disc 63 secured in bore 61 by means of said prongs. Machine screw 66, passing downwardly through washer 60, carries wingnut 67 and is threaded into the female threads in collar 65. Screw 66 may be adjusted whereby lower end 68 bears against any supporting surface and the rear of said base is raised or leveled; wingnut 67 is then adjusted to bear against washer 60 whereby the rear of base 11 is secured in such position.

A firearm such as a rifle or carbine may conveniently be secured in support 10 thus formed in essentialy horizontal condition for display or cleaning purposes. To remove the firearm, the user merely exerts an upward force and said firearm is easily removed from the respective front and rear support members.

It should be understood, of course, that the foregoing disclosure relates to only preferred embodiments of the invention and that numerous modifications or alterations may be made therein without departing from the spirit and scope of the invention as set forth in the appended claims.

I claim:

1. A firearm support comprising an elongated base, first and second transversely extending and longitudinally spaced support members on said base, first and second asymmetrical and coacting wedges carried in said first support member, first and second symmetrical and coacting wedges carried in said second support member, said wedges in said first and second support members adapted to firmly grip selected parts of a firearm carried therein.

2. The invention of claim 1 wherein said first support member comprises an outer plate, first and second laterally spaced side members, an inner plate, a block carried intermediate said first and second side members and outer and inner plates, said block adapted to bear against selected parts of said first and second wedges.

3. The invention of claim 1 wherein said first wedge in said first support member includes a slot, and a pin passing through said slot and secured to said outer plate or said inner plate.

4. The invention of claim 1 wherein said first wedge in said first support member includes a recess, and a projection on said outer plate or inner plate and at least partially inserting into said recess.

5. The invention of claim 2 including an elongated slot in the outer plate of said first member, and a pin passing through said slot and connecting to said block to selectively activate the wedges in said support member.

6. The invention of claim 1 wherein said outer plate and at least said first side member are integrally formed.

7. The invention of claim 1 including elevating means carried in said base outwardly of said first support member for bore aligning purposes.

* * * * *